US006968798B1

(12) United States Patent
Willis

(10) Patent No.: US 6,968,798 B1
(45) Date of Patent: Nov. 29, 2005

(54) ANCHOR WITH RELEASABLE SHANK

(75) Inventor: John A. Willis, Raleigh, NC (US)

(73) Assignee: Anchor Concepts, Inc., Zebulon, NC (US)

( * ) Notice: Subject to any disclaimer, the term of this patent is extended or adjusted under 35 U.S.C. 154(b) by 0 days.

(21) Appl. No.: 10/850,218

(22) Filed: May 20, 2004

(51) Int. Cl.[7] ..... B63B 21/32
(52) U.S. Cl. ..... 114/297; 114/298
(58) Field of Search ..... 114/297, 298, 304

(56) References Cited

U.S. PATENT DOCUMENTS

| | | | | |
|---|---|---|---|---|
| 2,161,906 A | * | 6/1939 | Filby | 114/301 |
| 2,948,249 A | * | 8/1960 | Gesner et al. | 114/298 |
| 3,180,304 A | * | 4/1965 | Brady | 114/297 |
| 3,463,112 A | * | 8/1969 | Jacevicius et al. | 114/298 |
| 4,111,147 A | | 9/1978 | Morissette | |
| 4,532,880 A | | 8/1985 | Dyer et al. | |
| 4,655,158 A | | 4/1987 | Holder | |
| 5,054,416 A | | 10/1991 | Zetah | |
| 6,119,618 A | | 9/2000 | Giles | |
| 6,155,194 A | * | 12/2000 | Hoareau | 114/304 |

OTHER PUBLICATIONS

"Digger Anchor" via www.fishandgame.com/diggeranchor on Mar. 30, 2004.

* cited by examiner

*Primary Examiner*—Sherman Basinger
(74) *Attorney, Agent, or Firm*—Coats & Bennett, P.L.L.C.

(57) ABSTRACT

An anchor has a shank pivotally connected to a fluke structure via a pivot mount for rotation between locked and release configurations. The shank has a locking surface distal from the pivot mount engaging a portion of the fluke structure to resist the rotation in the locked configuration. An elastically deformable member couples the shank to the pivot mount and the rotation of the shank may require the deformable member to be elastically deformed and the locking surface to be displaced toward the pivot mount. A float may be attached to the shank at a position spaced away from the fluke structure. A pulling force component applied to the shank in a direction from the pivot mount toward the locking surface may provide greater resistance to rotation of the shank. Other anchor embodiments are also disclosed.

27 Claims, 5 Drawing Sheets

ANCHOR WITH RELEASABLE SHANK

BACKGROUND OF THE INVENTION

The present invention is directed generally to anchors for watercraft, and more particularly to an anchor having a releasable shank.

As can be appreciated, marine anchors should set quickly once dropped in the water, but should be able to be retrieved without undue difficulty. Unfortunately, it is common for anchors to become lodged in or under various obstructions, such as submerged trees, rocky ledges, submerged wreckage, and the like. When this happens, the anchor may become trapped such that pulling on the anchor line, even from above or behind the anchor, cannot free the anchor. Such situations may require that someone dive down to free the anchor, or that the anchor line be cut to free the watercraft, neither of which is desirable.

In order to overcome this problem, several anchor designs have been proposed that, rather than having only one fixed geometric relationship between the shank and the fluke, allow for some form of relative movement (typically rotation) between the shank and the fluke. Examples of such anchors are shown in U.S. Pat. Nos. 5,054,416 and 4,655,158. For example, when an anchor according to the '416 patent becomes trapped as described above, the user actuates a special locking mechanism release that releases the anchor's shank to rotate relative to its fluke. When released, the shank may be rotated to a position extending rearward of the fluke, thereby allowing the anchor to be retrieved by pulling backward on the anchor.

While such anchors address the problem of a stuck anchor, these designs have not proven entirely satisfactory for various reasons. As such, there remains a need for alternative anchor designs.

SUMMARY OF THE INVENTION

The present invention is directed to an anchor that in one embodiment comprises a fluke structure having a pivot mount; a shank pivotally connected to the fluke structure via the pivot mount for rotation between a locked configuration and a release configuration; the shank having a locking surface distal from the pivot mount, the locking surface engaging the fluke structure to resist rotation of the shank relative to the fluke structure in the locked configuration; an elastically deformable member coupling the shank to the pivot mount; and wherein rotation of the shank from the locked configuration to the release configuration requires the deformable member to be elastically deformed and the locking surface to be displaced toward the pivot mount. The fluke structure may further comprise an incompressible locking member spaced from the pivot mount, and wherein the locking surface directly engages the locking member in the locked configuration. In some embodiments, the deformable member may urge the locking surface away from the pivot mount in the locked configuration. The deformable member may surround the pivot mount. The shank may further comprise a locking leg and wherein the locking leg forms the locking surface. A float may be attached to the shank at a position spaced away from the fluke structure. Rotation of the shank from the locked configuration to the release configuration may further require a circumferential pulling force about the pivot mount be applied to the shank above a first force level and counteracting force be applied to the fluke structure. A pulling force component applied to the shank in a direction from the pivot mount toward the locking surface may provide greater resistance to rotation of the shank from the locked configuration to the release configuration. An angle between the fluke structure and the shank may have a first value and the locking surface may engage the fluke structure to resist rotation of the shank relative to the fluke structure in the locked configuration, while the angle may have a second larger value and the locking surface may be disengaged from the locking member in the release configuration. The locking surface may be curved away from the pivot mount and the locking member may have a curved engaging portion so that the curved locking surface mates with the curved engaging portion when the shank is in the locked configuration to resist rotation of the shank relative to the fluke structure while the curved locking surface is disposed distal from the locking member in the release configuration.

In an alternate embodiment, the anchor may comprise a fluke structure having a pivot mount and an incompressible locking member disposed in spaced relation to the pivot mount; a shank pivotally connected to the fluke structure via the pivot mount for rotation with respect thereto generally about the pivot mount; the shank having a locking surface distal from the pivot mount; an elastically deformable member coupling the shank to the pivot mount; with the anchor rotationally moveable between a locked configuration wherein an angle between the fluke structure and the shank has a first value and the locking surface engages the fluke structure to resist relative rotation of the shank relative to the fluke structure and a release configuration wherein the angle has a second larger value and the locking surface is disengaged from the locking member. Rotation of the shank from the locked configuration to the release configuration may require the deformable member to be elastically deformed and the locking surface to be displaced toward the pivot mount. In some embodiments, the deformable member may urge the locking surface away from the pivot mount in the locked configuration. The deformable member may surround the pivot mount. The shank may further comprise a locking leg and wherein the locking leg forms the locking surface. A float may be attached to the shank at a position spaced away from the fluke structure. Rotation of the shank from the locked configuration to the release configuration may further require a circumferential pulling force about the pivot mount be applied to the shank above a first force level and counteracting force be applied to the fluke structure. A pulling force component applied to the shank in a direction from the pivot mount toward the locking surface may provide greater resistance to rotation of the shank from the locked configuration to the release configuration. The locking surface may be curved away from the pivot mount and the locking member may have a curved engaging portion so that the curved locking surface mates with the curved engaging portion when the shank is in the locked configuration to resist rotation of the shank relative to the fluke structure while the curved locking surface is disposed distal from the locking member in the release configuration.

In still another embodiment, the anchor may comprise a fluke structure having a pivot mount and an incompressible locking member disposed in spaced relation to the pivot mount having a curved engaging portion; a shank pivotally connected to the fluke structure via the pivot mount for rotation with respect thereto generally about the pivot mount between a locked configuration and a release configuration; the shank having a forward leg distal from the pivot mount having a curved locking surface corresponding in shape to the curved engaging portion and curved away from the pivot mount; an elastically deformable member coupling the shank to the pivot mount; the curved locking surface mating with the curved engaging portion when the shank is in the locked configuration to resist rotation of the shank relative to the fluke structure; and the curved locking surface disposed distal from the locking member in the release configuration. Rotation of the shank from the locked configuration to the release configuration may require the deformable member to be elastically deformed and the locking surface to be displaced toward the pivot mount. In some embodiments, the deformable member may urge the locking surface away from the pivot mount in the locked configuration. The deformable member may surround the pivot mount. The shank may further comprise a locking leg and wherein the locking leg forms the locking surface. A float may be attached to the shank at a position spaced away from the fluke structure. Rotation of the shank from the locked configuration to the release configuration may further require a circumferential pulling force about the pivot mount be applied to the shank above a first force level and counteracting force be applied to the fluke structure. A pulling force component applied to the shank in a direction from the pivot mount toward the locking surface may provide greater resistance to rotation of the shank from the locked configuration to the release configuration. An angle between the fluke structure and the shank may have a first value and the locking surface may engage the fluke structure to resist rotation of the shank relative to the fluke structure in the locked configuration, while the angle may have a second larger value and the locking surface may be disengaged from the locking member in the release configuration.

DETAILED DESCRIPTION OF ONE OR MORE EMBODIMENTS

Figure 1:
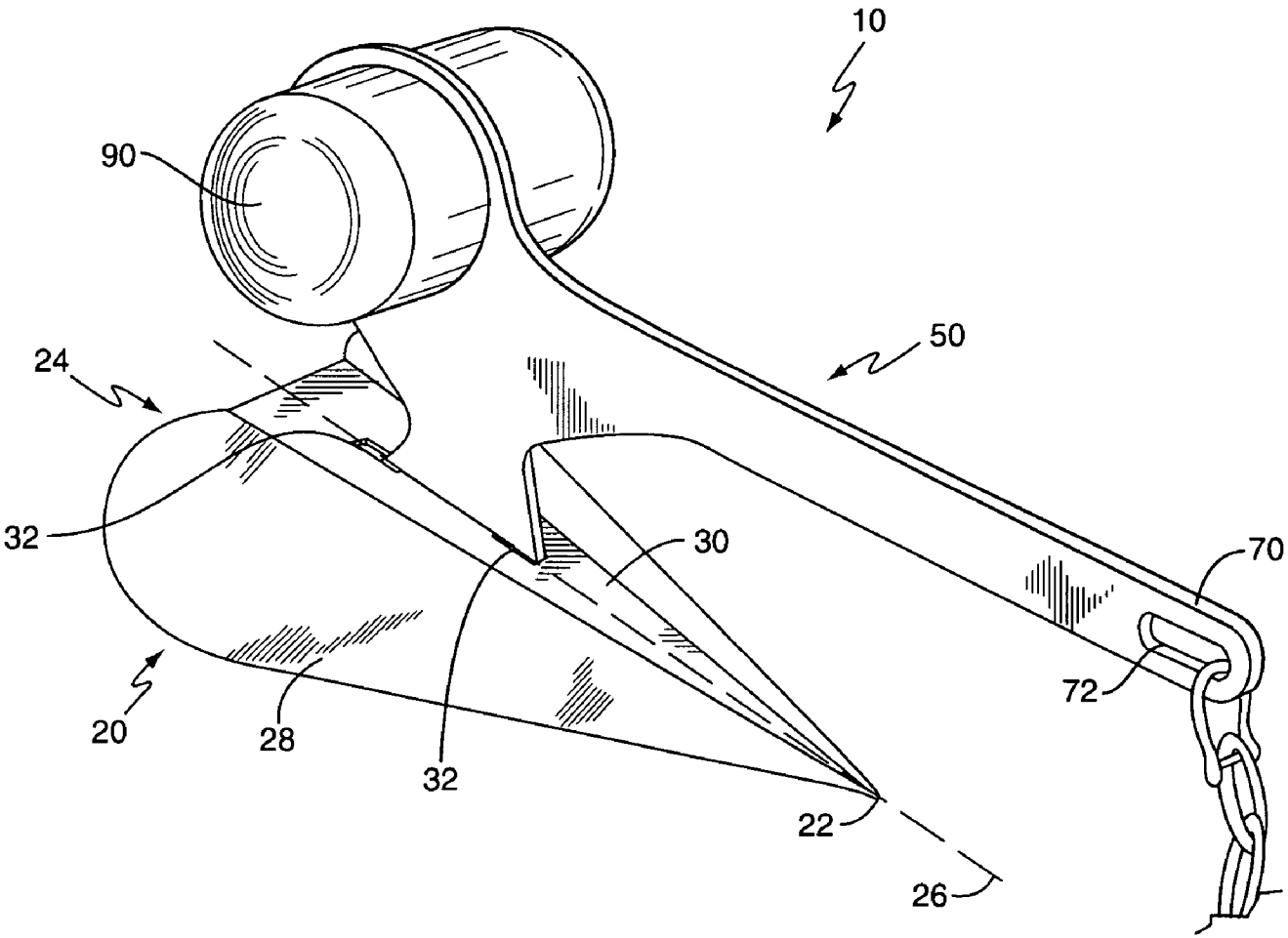
FIG. 1 shows a perspective view of an anchor constructed in accordance with one embodiment of the present invention.

An anchor according to one embodiment of the present invention, generally designated 10, includes a fluke 20 and a shank 50. The fluke 20 in FIG. 1 has a pointed fore tip 22 and a broad aft tail 24 and extends generally along longitudinal axis 26. The fluke 20 includes a pair of side surfaces (or wings) 28 joined by a third surface, referred to herein as a bridging surface 30. The wings 28 are generally triangular in shape with a generally straight lower edge and a curved rear edge. The two wings 28 of FIG. 1 are of the same general shape, are disposed symmetrically about the longitudinal axis 26, and are canted with respect to one another. The wings 28 preferably meet at, and help form, the pointed tip 22 of the fluke 20. The bridging surface 30 is also generally triangular in shape. Located in a middle portion of the bridging surface 30 are a plurality of mounting slots 32 that may be generally rectangular in shape.

The fluke 20 further includes a pair of downwardly extending flanges 34 extending from the underside of the bridging surface 30, one on each side of the slots 32. The flanges 34 include a pair of aligned holes 36 for an aft-positioned pivot mount 40, a pair of holes 37 for a forward-positioned locking pin 42, and optionally a plurality of intervening cutouts 38. The later mentioned cutouts 38 help to reduce weight and allow easy cleaning of the underside of the anchor 10. The pivot mount 40 runs laterally between the flanges 34 and is oriented generally perpendicular to the longitudinal axis 26. The pivot mount 40 may take any suitable form that forms functional pivot axis 40*a* for the shank 50 as discussed below. For example, the pivot mount 40 may be a hard stainless steel pin (e.g., a portion of a shackle, hasp, bolt, or the like) either pressed into holes 36 on the flanges 34 or attached by threads, nuts, spring clips, etc. Alternatively, the pivot mount 40 may be a pair of stub pins, one extending from each flange 34, etc. Likewise, the locking pin 42 runs laterally between the flanges 34, generally parallel to but spaced from the pivot mount 40. The locking pin 42 is advantageously an incompressible single or multiple part body, able to withstand substantial loads without significant deformation or deflection. For example, the locking pin 42 may be a hard stainless steel pin either pressed into holes 37 on the flanges 34 or attached by threads, nuts, etc. Alternatively, the locking pin 42 may include a bolt or other fastener supporting a collar 42*r* between the flanges 34. This collar 42*r* may advantageously take the form of a hard roller. The locking pin 42 advantageously includes a curved outer surface, at least on the portion facing the pivot mount 40.

The main body of the fluke 20 is preferably made from a single piece of metallic material, such as sheet steel, galvanized steel, stainless steel, aluminum, or other material suitable for aquatic environments. Alternatively, the main body of the fluke 20 may be formed from distinct pieces that are fastened or otherwise secured together, such as by welding.

The shank 50 shown in FIG. 1 is a generally elongate member having a base section 52 and a head section 70. The base section 52 includes a plurality of downwardly extending legs, including a rear leg 54 and a front leg 60. These legs 54,60 are dimensioned so as to be able to be inserted through the corresponding slots 32 on the fluke 20. The rear leg 54 includes an aperture 56 that advantageously surrounds and is centered about the pivot mount 40. The front leg 60 includes a locking surface 62 that is advantageously curved so as to correspond to the curve of the outer surface of the locking pin 42 closest to the pivot mount 40. Thus, the locking surface 62 is advantageously curved toward the locking pin 42 and away from the pivot mount 40. The head section 70 is generally elongate, extending in direction X, and includes a slot 72 towards the end thereof for connecting an anchor line. The shank 50 may be made from similar materials as the fluke 20, but may advantageously be made from a less dense material so that the majority of the mass of the combined shank 50 and fluke 20 resides in the fluke 20.

Figure 4:
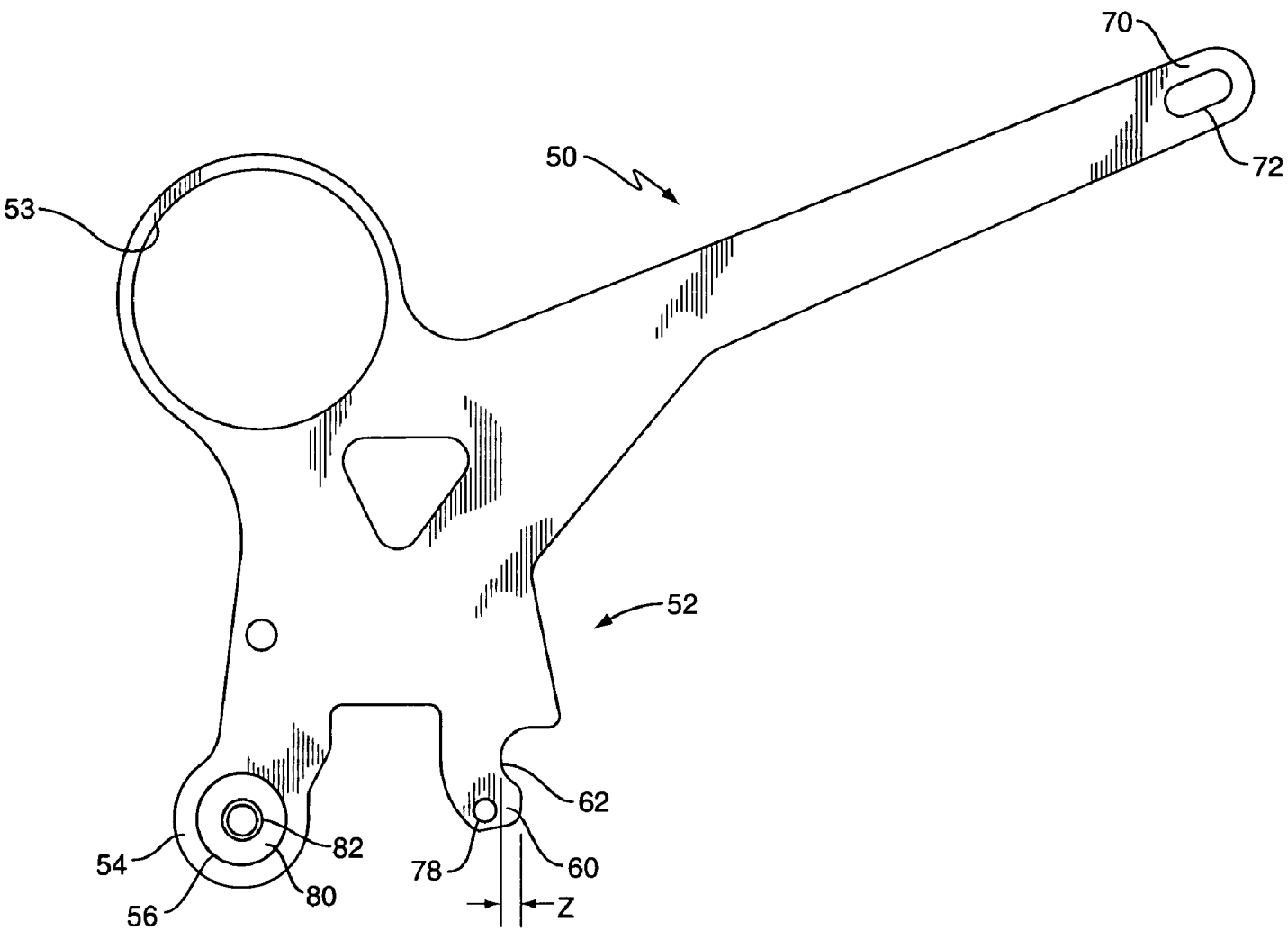
FIG. 4 shows a side view of the shank of the anchor of FIG. 1 with the elastic member added.
Figure 5:
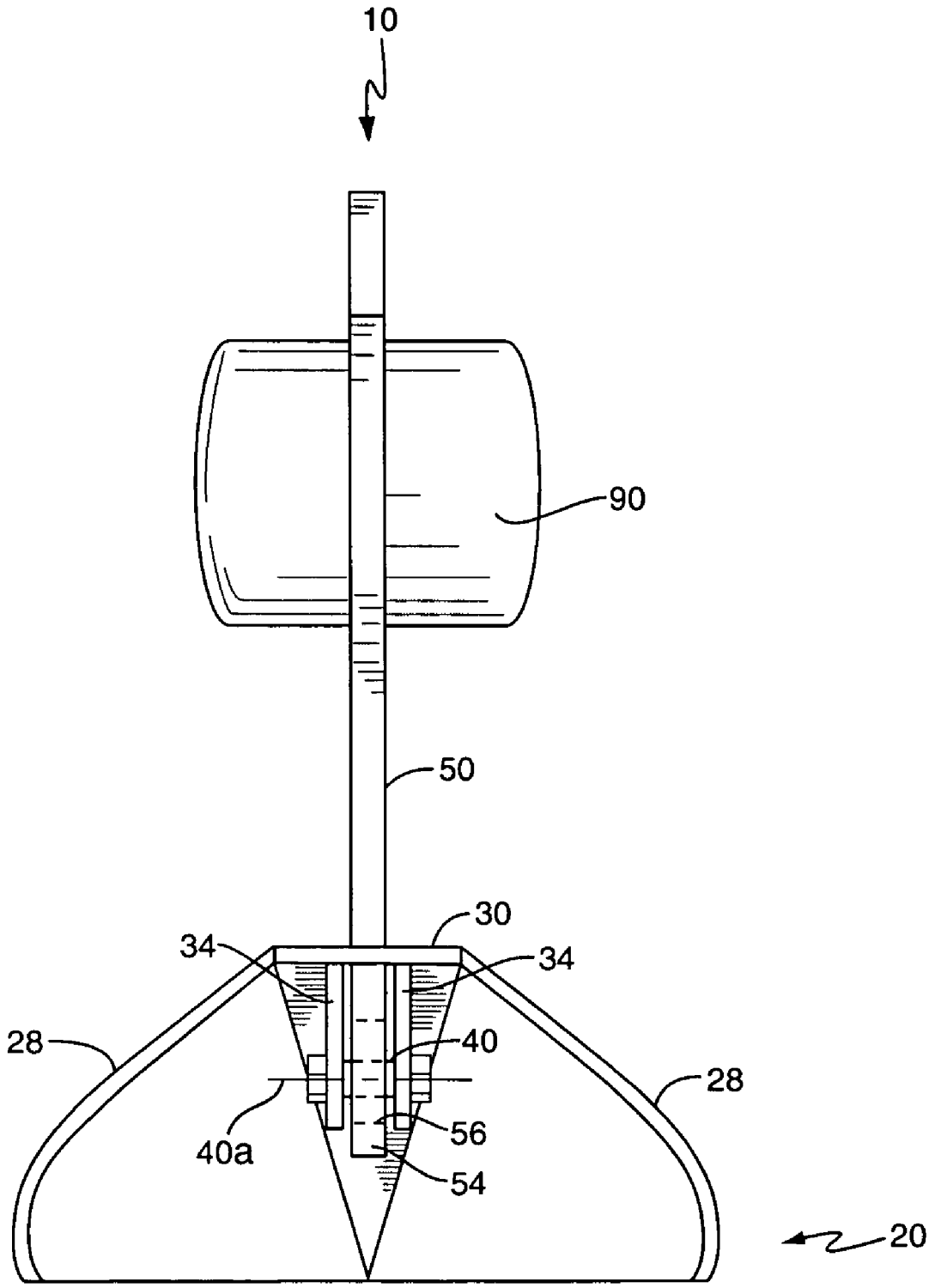
FIG. 5 shows a back view of the anchor of FIG. 1.

The shank 50 of the anchor 10 shown in FIG. 1 is rotatably mounted to the fluke 20 via the pivot mount 40. In some embodiments, the anchor 10 includes an elastic member 80 disposed between the pivot member and the shank 50, as shown in FIG. 4. This elastic member 80 is elastically deformable, and may take the form of a disc-shaped elastomeric bushing, such as a rubber or urethane bushing having a durometer hardness of approximately 60 Shore A, having a hole in a central area thereof. The elastic member 80 fits in the aperture 56 in the rear leg 54 of the shank 50, and around the pivot mount 40. The intent of the elastic member 80 is to allow for displacement of the shank 50 relative to the fluke 20 in the general direction of a theoretical line Y running between the center of the pivot mount 40 and the center of the locking pin 42. In simple terms, the elastic member 80 allows the shank 50 to "slide back" relative to the fluke 20. The elastic member 80 may be in a quiescent state when the shank 50 is in the locked configuration (e.g., center of elastic member 80 aligned with center of pivot mount 40), or the elastic member 80 may apply a forward bias to the shank 50 in the locked configuration, urging it toward the locking pin 42. The elastic member 80 may, if desired, optionally include an additional wear resistant bushing 82 disposed therein, such as brass or other metallic bushing. Such an additional bushing 82 allows for metal to metal contact at the bearing surfaces associated with pivot mount 40.

It should be noted that while it is believed advantageous, the elastic member 80 need not completely surround the pivot mount 40. For example, the elastic member 80 may be disposed just on one side of the pivot mount 40. Alternatively, the elastic member 80 may be formed by a plurality of coil springs connecting the shank 50 to the pivot mount 40. Other connecting structures that connect the shank 50 to the pivot mount 40 while allowing for rotational and longitudinal displacement of the shank 50 relative to the pivot mount 40 may also be employed.

Figure 2:
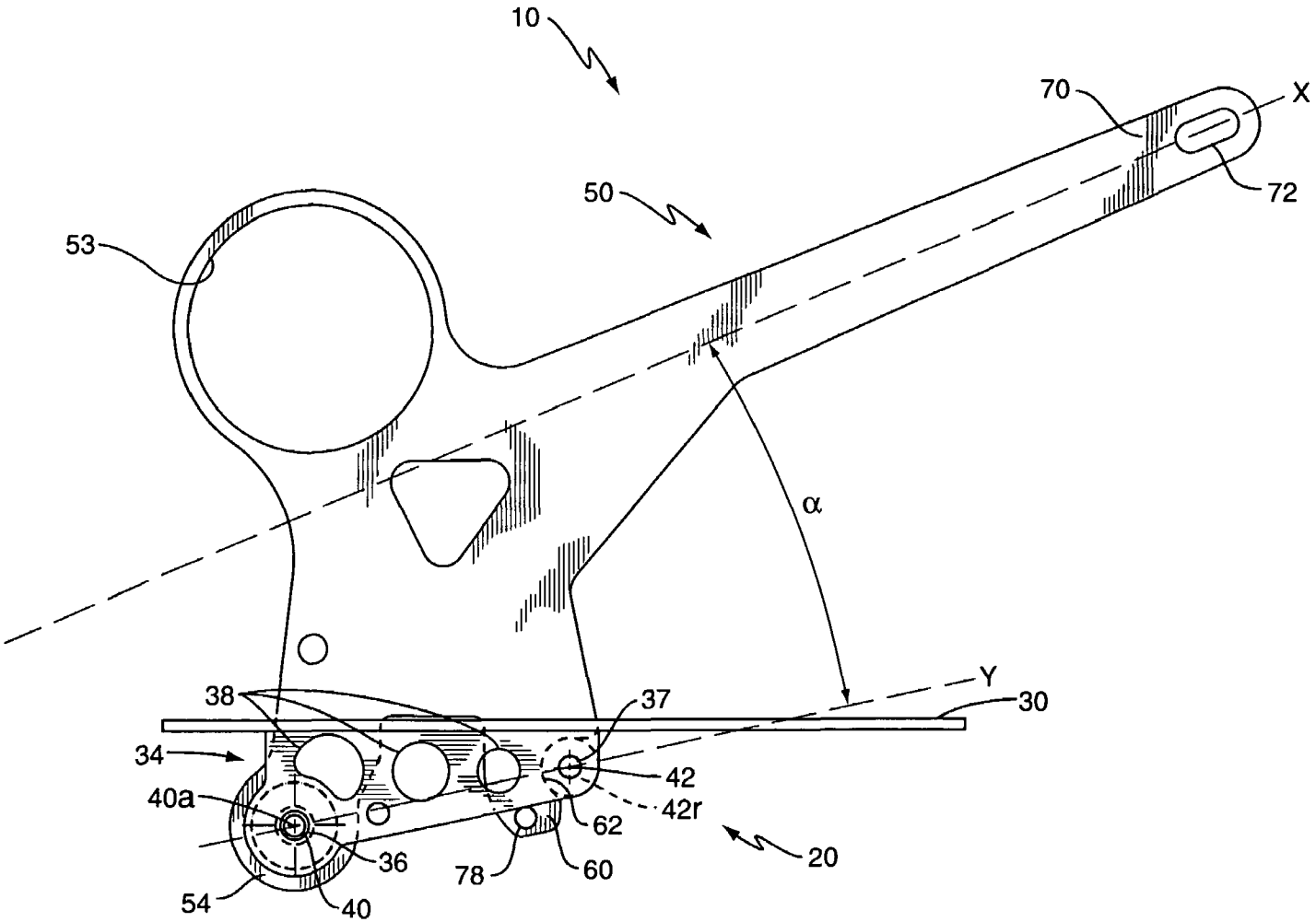
FIG. 2 shows side view of the anchor of FIG. 1 in the locked configuration with the wings removed.

The anchor 10 of the present invention may be used as a conventional anchor when in the locked configuration shown in FIG. 2. In the locked configuration, the locking surface 62 of the front leg of the shank 50 engages, and may optionally be pressed forward against, the locking pin 42. Because a portion of the front leg 60 below center of the locking pin 42 extends more forward than the rearmost portion (closest to pivot mount 40) of the locking surface 62, there is substantial resistance to rotation of the shank 50 with respect to the fluke 20. Further, due to the arrangement of the locking surface 62 of the front leg 60 and the locking pin 42 in some embodiments, any forward component of the pulling force exerted on the shank 50 by the anchor line will tend to cause the locking surface 62 to bear more firmly against the locking pin 42, helping to ensure that the shank 50 stays locked. Thus, when the watercraft is pulling on the anchor 10, it is believed that the locking pin 42 carries the majority of the pulling load, with the pivot mount 40 carrying only a small portion. In this manner, the anchor 10 performs the conventional anchoring function expected of marine anchors. If the anchor 10 is not lodged under some obstruction, then removal of the anchor 10 merely requires an upward pull on the anchor line in a conventional fashion. Because the interaction of the elastic member 80, the locking surface 62 and the locking pin, the locking surface 62 should stay engaged with the locking pin 42, and the anchor 10 should therefore stay in the locked configuration while being retrieved and stored.

Figure 3:
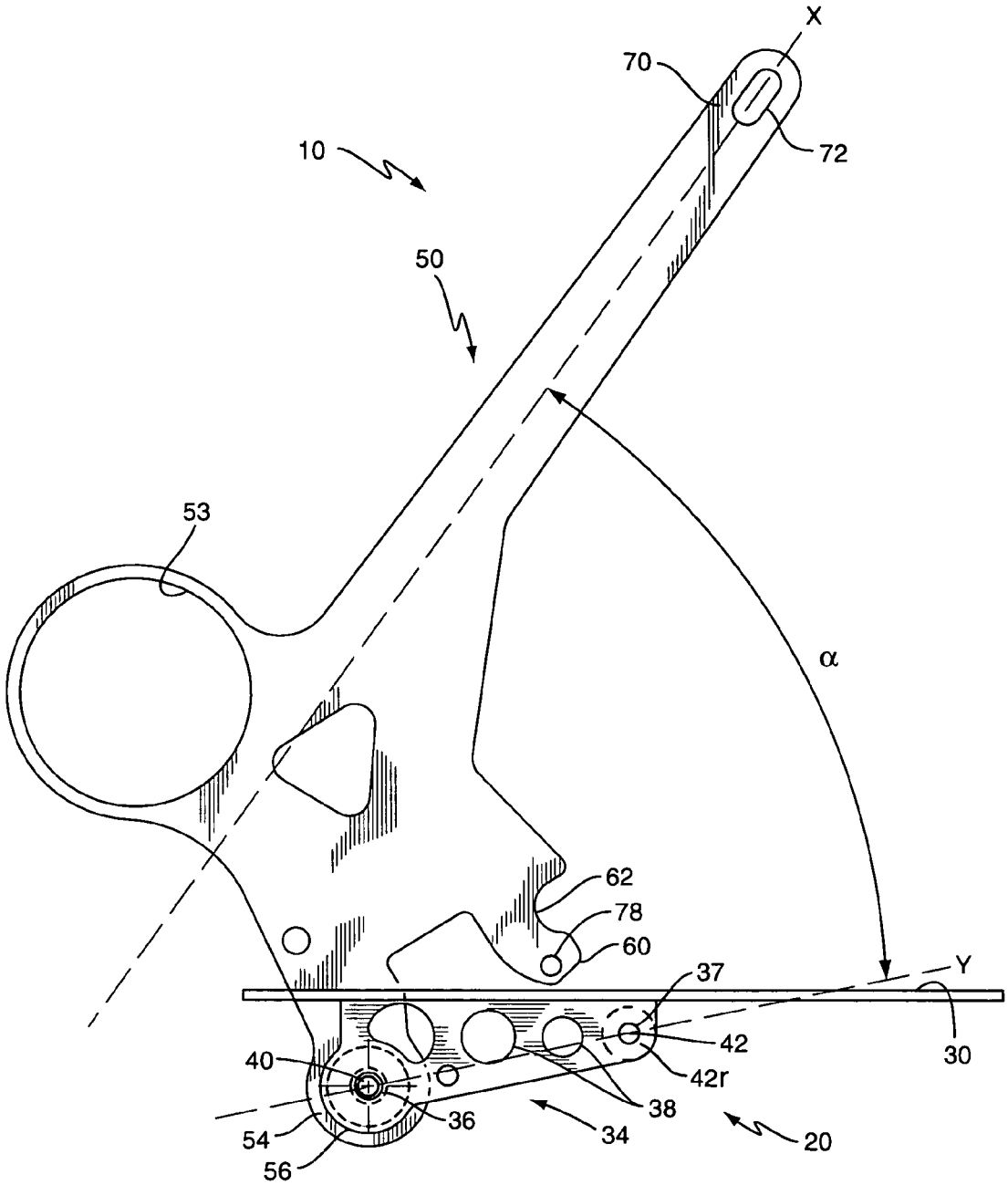
FIG. 3 shows side view of the anchor of FIG. 1 in the release configuration with the wings removed.

However, if the anchor 10 becomes lodged under some obstruction, with the fluke 20 under the obstruction and the shank 50 above the obstruction, then the anchor 10 of the present invention becomes particularly advantageous. Under such circumstances, a pull on the anchor line from above/behind the anchor 10 will result in a torque being applied to the shank 50 that can be modeled as a moment arm on the shank 50 about the pivot mount 40 caused by a circumferential force being applied to the head section 70 of the shank 50. This force will tend to cause the shank 50 to rotate about the pivot axis 40*a* running through the pivot mount 40. However, this rotation is resisted by the interaction of the locking surface 62 and the locking pin 42. When enough force is applied, the interaction of the curved locking surface 62 with the locking pin 42 will cause the shank 50 to be displaced rearward with respect to the fluke 20 approximately along line Y. In order to move rearward, the elastic member 80 is deformed. When the shank 50 has moved rearward far enough, the front leg 60 will be able to clear the locking pin 42, and the shank 50 will "pop" free, allowing the shank 50 to rotate (counter-clockwise in FIG. 3) relatively freely with respect to the fluke 20. By continuing up/back pull on the anchor line, the shank 50 may be rotated back to a fully open position, and the anchor 10 may be pulled back out from under the obstruction. The anchor 10 is then pulled up in the open or released configuration and brought on board the watercraft. The shank 50 may then be rotated forward with respect to the fluke 20 and pressed down so that the bottom of the front leg 60 passes the locking pin 42 so as to allow the locking surface 62 to again engage the locking pin 42, thereby resetting the anchor 10 to the locked configuration.

As can be appreciated, the rotational movement of the shank 50 relative to the fluke 20 from the locked configuration (FIG. 2) to the released configuration (FIG. 3) changes the angular relationship between the fluke 20 and the shank 50. In the locked or normal configuration, the angle $\alpha$ between line X associated with the shank 50 and line Y associated with the fluke 20 is a first value, such as 5°–45°, advantageously approximately 15°. When an appropriately large opening force is applied, the anchor 10 opens to the released configuration with the angle $\alpha$ increasing to a larger value. Note that while the shank 50 may advantageously rotate to a position where angle $\alpha$ is approximately 180° when fully open, this is not required in all embodiments. Further, the released configuration is achieved before the shank 50 reaches the fully open position, and merely requires that the locking surface 62 be disengaged from the locking pin 42 and angle $\alpha$ to be larger than that in the locked configuration; no specific amount of angular openness is required.

The force component required to move the shank 50 from the locked configuration to the released configuration, or vice versa, will depend on the size of the anchor 10, the length of the shank 50, the resistance of the elastic member 80, and the amount of longitudinal displacement Z required to have the locking surface 62 clear the locking pin 42. The required force component should be large enough to prevent unintended opening of the anchor 10, such as being fifty pounds or more.

To assemble a preferred embodiment of the anchor 10, the elastic member 80 is added to the shank 50 and the pivot mount 40 is inserted through the elastic member 80 and mated to the flanges 34 on the fluke 20 in some suitable fashion. The locking pin 42 is also mated to the flanges 34 in some suitable fashion, and the shank 50 is then rotated forward until the locking surface 62 engages the locking pin 42. Of course, the sequence of assembly described above is but one of a variety of methods of making an anchor 10 according to the present invention. The sequence and inclusion of certain steps is for illustrative purposes only and is specifically not intended to be limiting as to the method of manufacture or the ultimate structure achieved.

To use the anchor 10, a suitable anchor line or chain may be attached to the anchor 10 via the slot 72 on the end of the shank 50. Thereafter, the anchor 10 is dropped, tossed, hurled, or otherwise released into the water. Once in the water, the anchor 10 will begin to sink through the water until it reaches the bottom. The anchor 10 is then set in a conventional fashion. To remove the anchor 10, the user pulls the anchor 10 line as described above. Thereafter, the anchor 10 may simply be hauled aboard the watercraft in the customary fashion. Also, it should be noted that the anchor 10 may be placed in the released configuration for storage if desired.

The shank 50 may further optionally include a mounting hole 53 in the base section 52 disposed above the legs 54,60 for mounting a float 90 if desired. The optional float 90 may take a wide variety of shapes, but the float 90 is preferably generally cylindrical in shape with closed hemispherical ends, such as that disclosed in U.S. Pat. No. 6,041,731 and/or U.S. Pat. No. 6,390,010, the disclosures of both of which are incorporated herein by reference. The float version of the anchor 10 is believed to quickly assume a generally upright orientation, i.e., shank 50 up and fluke 20 down, upon entry into the water. This action is believed to be due to the location of the float 90 relative to the center of gravity of the anchor 10 and the tip 22 of the fluke 20. This upright orientation is believed to aid in quickly setting the anchor 10 by allowing the tip 22 of the fluke 20 to be oriented to penetrate the bottom without dragging the anchor 10 along the bottom. The optional float 90 may be added to the shank 50 before or after the shank 50 is coupled to the fluke 20.

It may be desirable in some situations to disable the shank 50 release feature. Thus, some embodiments of the anchor 10 have a front leg 60 that extends substantially below the flanges 34 so as to expose a through hole 78 therein disposed below the locking surface 62. A locking retainer (not shown), such as a spring latch, shackle pin, or the like, may be inserted through the hole 78 in the front leg 60 and thereby prevent the front leg 60 from moving upward beyond the flanges 34. This locking retainer may be removed when it is desired to re-enable the shank release feature.

The anchor 10 of FIG. 1 employs a single fluke 20; however, the present invention is not so limited. For example, an anchor according to one embodiment of the present invention may have a fluke structure with multiple flukes 20. For such an embodiment, the pivot mount 40 may be a portion of the multi-fluke fluke structure rather than dedicated, or forming part of, a single fluke 20. As such, the term "fluke structure" is intended to encompass single flukes 20, multiple flukes 20, where each fluke 20 may have multiple tines.

The present invention may, of course, be carried out in other specific ways than those herein set forth without departing from the essential characteristics of the invention. The present embodiments are, therefore, to be considered in all respects as illustrative and not restrictive, and all changes coming within the meaning and equivalency range of the appended claims are intended to be embraced therein.

What is claimed is:

1. An anchor, comprising:

a fluke structure having a pivot mount;

a shank pivotally connected to said fluke structure via said pivot mount for rotation between a locked configuration and a release configuration; said shank having a locking surface distal from said pivot mount, said locking surface engaging said fluke structure to resist rotation of said shank relative to said fluke in said locked configuration;

an elastically deformable member coupling said shank to said pivot mount; and wherein rotation of said shank from said locked configuration to said release configuration requires said deformable member to be elastically deformed and said locking surface to be displaced toward said pivot mount.

2. The anchor of claim 1 wherein said fluke structure further comprises an incompressible locking member spaced from said pivot mount, and wherein said locking surface engages said locking member in said locked configuration.

3. The anchor of claim 2 wherein an angle between said fluke structure and said shank has a first value and said locking surface engages said fluke to resist rotation of said shank relative to said fluke structure in said locked configuration, and wherein said angle has a second larger value and said locking surface is disengaged from said locking member in said release configuration.

4. The anchor of claim 2 wherein said locking surface is curved away from said pivot mount and said locking member has a curved engaging portion; and wherein said curved locking surface mates with said curved engaging portion when said shank is in said locked configuration to resist rotation of said shank relative to said fluke structure; and wherein said curved locking surface is disposed distal from said locking member in said release configuration.

5. The anchor of claim 1 wherein said deformable member urges said locking surface away from said pivot mount in said locked configuration.

6. The anchor of claim 1 wherein said deformable member surrounds said pivot mount.

7. The anchor of claim 1 wherein said shank further comprises a locking leg and wherein said locking leg forms said locking surface.

8. The anchor of claim 1 further comprising a float attached to said shank at a position spaced away from said fluke structure.

9. The anchor of claim 1 wherein rotation of said shank from said locked configuration to said release configuration further requires a circumferential pulling force about said pivot mount be applied to said shank above a first force level and counteracting force be applied to said fluke structure.

10. The anchor of claim 1 wherein a pulling force component applied to said shank in a direction from said pivot mount toward said locking surface provides greater resistance to rotation of said shank from said locked configuration to said release configuration.

11. The anchor of claim 1:

wherein said shank further comprises a locking leg and wherein said locking leg forms said locking surface;

wherein said fluke structure further comprises an incompressible locking member spaced from said pivot mount, and wherein said locking surface engages said locking member in said locked configuration;

wherein said deformable member surrounds said pivot mount;

further comprising a float attached to said shank at a position spaced away from said fluke structure;

wherein rotation of said shank from said locked configuration to said release configuration further requires a circumferential pulling force about said pivot mount be applied to said shank above a first force level and counteracting force be applied to said fluke structure;

wherein a pulling force component applied to said shank in a direction from said pivot mount toward said locking surface provides greater resistance to rotation of said shank from said locked configuration to said release configuration;

wherein an angle between said fluke structure and said shank has a first value and said locking surface engages said fluke to resist rotation of said shank relative to said fluke structure in said locked configuration, and wherein said angle has a second larger value and said locking surface is disengaged from said locking member in said release configuration wherein said locking surface is curved away from said pivot mount and said locking member has a curved engaging portion; and wherein said curved locking surface mates with said curved engaging portion when said shank is in said locked configuration to resist rotation of said shank relative to said fluke structure; and wherein said curved locking surface is disposed distal from said locking member in said release configuration.

12. An anchor, comprising:

a fluke structure having a pivot mount and an incompressible locking member disposed in spaced relation to said pivot mount;

a shank pivotally connected to said fluke structure via said pivot mount for rotation with respect thereto generally about said pivot mount; said shank having a locking surface distal from said pivot mount;

an elastically deformable member coupling said shank to said pivot mount;

said anchor rotationally moveable between a locked configuration wherein an angle between said fluke structure and said shank has a first value and said locking surface engages said fluke to resist relative rotation of said shank relative to said fluke structure and a release configuration wherein said angle has a second larger value and said locking surface is disengaged from said locking member; and wherein said deformable member urges said locking surface away from said pivot mount in said locked configuration.

13. The anchor of claim 12 wherein rotation of said shank from said locked configuration to said release configuration requires said deformable member to be elastically deformed and said locking surface to be displaced toward said pivot mount.

14. An anchor, comprising:

a fluke structure having a pivot mount and an incompressible locking member disposed in spaced relation to said pivot mount;

a shank pivotally connected to said fluke structure via said pivot mount for rotation with respect thereto generally about said pivot mount; said shank having a locking surface distal from said pivot mount;

an elastically deformable member coupling said shank to said pivot mount;

said anchor rotationally moveable between a locked configuration wherein an angle between said fluke structure and said shank has a first value and said locking surface engages said fluke to resist relative rotation of said shank relative to said fluke structure and a release configuration wherein said angle has a second larger value and said locking surface is disengaged from said locking member; and wherein said deformable member surrounds said pivot mount.

15. An anchor, comprising:

a fluke structure having a pivot mount and an incompressible locking member disposed in spaced relation to said pivot mount;

a shank pivotally connected to said fluke structure via said pivot mount for rotation with respect thereto generally about said pivot mount; said shank having a locking surface distal from said pivot mount;

an elastically deformable member coupling said shank to said pivot mount;

said anchor rotationally moveable between a locked configuration wherein an angle between said fluke structure and said shank has a first value and said locking surface engages said fluke to resist relative rotation of said shank relative to said fluke structure and a release configuration wherein said angle has a second larger value and said locking surface is disengaged from said locking member; and wherein a pulling force component applied to said shank in a direction from said pivot mount toward said locking surface provides greater resistance to rotation of said shank from said locked configuration to said release configuration.

16. The anchor of claim 15 wherein said shank further comprises a locking leg and wherein said locking leg forms said locking surface.

17. The anchor of claim 15 further comprising a float attached to said shank at a position spaced away from said fluke structure.

18. The anchor of claim 15 wherein said locking surface is curved away from said pivot mount and said locking member has a curved engaging portion; and wherein said curved locking surface mates with said curved engaging portion when said shank is in said locked configuration to resist rotation of said shank relative to said fluke structure; and wherein said curved locking surface is disposed distal from said locking member in said release configuration.

19. The anchor of claim 15 wherein said fluke structure consists of a single fluke.

20. An anchor, comprising:

a fluke structure having a pivot mount and an incompressible locking member disposed in spaced relation to said pivot mount having a curved engaging portion;

a shank pivotally connected to said fluke via said pivot mount for rotation with respect thereto generally about said pivot mount between a locked configuration and a release configuration; said shank having a forward leg distal from said pivot mount having a curved locking surface corresponding in shape to said curved engaging portion and curved away from said pivot mount;

an elastically deformable member coupling said shank to said pivot mount;

said curved locking surface mating with said curved engaging portion when said shank is in said locked configuration to resist rotation of said shank relative to said fluke structure;

said curved locking surface disposed distal from said locking member in said release configuration; and wherein said deformable member urges said locking surface away from said pivot mount in said locked configuration.

21. The anchor of claim 20 wherein rotation of said shank from said locked configuration to said release configuration requires said deformable member to be elastically deformed and said locking surface to be displaced toward said pivot mount.

22. An anchor, comprising:

a fluke structure having a pivot mount and an incompressible locking member disposed in spaced relation to said pivot mount having a curved engaging portion;

a shank pivotally connected to said fluke via said pivot mount for rotation with respect thereto generally about said pivot mount between a locked configuration and a release configuration; said shank having a forward leg distal from said pivot mount having a curved locking surface corresponding in shape to said curved engaging portion and curved away from said pivot mount;

an elastically deformable member coupling said shank to said pivot mount;

said curved locking surface mating with said curved engaging portion when said shank is in said locked configuration to resist rotation of said shank relative to said fluke structure;

said curved locking surface disposed distal from said locking member in said release configuration; and wherein said deformable member surrounds said pivot mount.

23. An anchor, comprising:

a fluke structure having a pivot mount and an incompressible locking member disposed in spaced relation to said pivot mount having a curved engaging portion;

a shank pivotally connected to said fluke via said pivot mount for rotation with respect thereto generally about said pivot mount between a locked configuration and a release configuration; said shank having a forward leg distal from said pivot mount having a curved locking surface corresponding in shape to said curved engaging portion and curved away from said pivot mount;

an elastically deformable member coupling said shank to said pivot mount;

said curved locking surface mating with said curved engaging portion when said shank is in said locked configuration to resist rotation of said shank relative to said fluke structure;

said curved locking surface disposed distal from said locking member in said release configuration; and wherein rotation of said shank from said locked configuration to said release configuration further requires a circumferential pulling force about said pivot mount be applied to said shank above a first force level and counteracting force be applied to said fluke structure.

24. An anchor, comprising:

a fluke structure having a pivot mount and an incompressible locking member disposed in spaced relation to said pivot mount having a curved engaging portion;

a shank pivotally connected to said fluke via said pivot mount for rotation with respect thereto generally about said pivot mount between a locked configuration and a release configuration; said shank having a forward leg distal from said pivot mount having a curved locking surface corresponding in shape to said curved engaging portion and curved away from said pivot mount;

an elastically deformable member coupling said shank to said pivot mount;

said curved locking surface mating with said curved engaging portion when said shank is in said locked configuration to resist rotation of said shank relative to said fluke structure;

said curved locking surface disposed distal from said locking member in said release configuration; and wherein a pulling force component applied to said shank in a direction from said pivot mount toward said locking surface provides greater resistance to rotation of said shank from said locked configuration to said release configuration.

25. The anchor of claim 24 wherein said shank further comprises a locking leg and wherein said locking leg forms said locking surface.

26. The anchor of claim 24 further comprising a float attached to said shank at a position spaced away from said fluke structure.

27. The anchor of claim 24 wherein an angle between said fluke structure and said shank has a first value and said locking surface engages said fluke to resist rotation of said shank relative to said fluke in said locked configuration, and wherein said angle has a second larger value and said locking surface is disengaged from said locking member in said release configuration.

* * * * *